US006366257B1

(12) United States Patent
Ramanujam et al.

(10) Patent No.: US 6,366,257 B1
(45) Date of Patent: Apr. 2, 2002

(54) INTEGRATED DUAL BEAM REFLECTOR ANTENNA

(75) Inventors: Parthasarathy Ramanujam, Redondo Beach; Michael E. Pekar, La Mirada; David M. Kershner, Los Angeles; Brian M. Park, Torrance; Donald L. Davis, Lakewood, all of CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/713,114

(22) Filed: Nov. 15, 2000

(51) Int. Cl.[7] ..... H01Q 13/00
(52) U.S. Cl. ..... 343/781 P; 343/755; 343/761
(58) Field of Search ..... 343/755, 756, 343/761, 779, 781 P, 781 R, 836, 837; H01Q 13/00, 21/00

(56) References Cited

U.S. PATENT DOCUMENTS 4,618,866 A * 10/1986 Makino et al. ..... 343/779
5,136,294 A * 8/1992 Iwata ..... 343/781 P
5,512,913 A * 4/1996 Staney ..... 343/781 P
5,751,254 A * 5/1998 Bird et al. ..... 343/761
5,977,926 A * 11/1999 Gilger ..... 343/781 P
6,225,964 B1 * 5/2001 Fermelia et al. ..... 343/909

* cited by examiner

*Primary Examiner*—Tho Phan
(74) *Attorney, Agent, or Firm*—Gates & Cooper LLP

(57) ABSTRACT

The present invention discloses a method for generating multiple antenna beams and a system for generating multiple antenna beams. The system comprises a first reflector surface that has a primary and at least a first auxiliary surface, and a second reflector surface, and also comprises first, second, and third feed horns. The first feed horn illuminates the primary surface with radio frequency (RF) energy, the second feed horn illuminates the auxiliary surface with RF energy, and the third feed horn illuminates the second reflector surface with RF energy. The first feed horn and third feed horn are removed from an axis of symmetry of the first auxiliary surface. The method comprises illuminating a primary portion of a first reflector surface with radio frequency (RF) energy from a first feed horn, illuminating an auxiliary portion of the first reflector surface with RF energy from a second feed horn, illuminating a second reflector surface with RF energy from a third feed horn, wherein the first feed horn and third feed horn are removed from an axis of symmetry of the auxiliary portion of the first reflector surface.

20 Claims, 11 Drawing Sheets

INTEGRATED DUAL BEAM REFLECTOR ANTENNA

BACKGROUND OF THE INVENTION

1. Field of the Invention

This invention relates in general to antenna systems, and in particular to an integrated dual beam reflector antenna.

2. Description of the Related Art

Communications satellites have become commonplace for use in many types of communications services, e.g., data transfer, voice communications, television spot beam coverage, and other data transfer applications. As such, satellites must provide signals to various geographic locations on the Earth's surface. As such, typical satellites use customized antenna designs to provide signal coverage for a particular country or geographic area.

Satellites are typically required to generate multiple beams to provide multiple or overlapping geographical areas with communications signals. Typically, satellites use multiple antennas or a shaped reflector antenna to provide the multiple beams required. Shaped reflector antennas can be optimized for a given shaped beam, but it is desirable to generate multiple beams from a single shaped surface for ease of mechanical packaging. The single shaped surface, however, has a degraded performance with respect to multiple shaped reflector surfaces, which is the main reason for using multiple shaped reflectors to generate multiple coverage beams. By having multiple shaped reflector surfaces, severe demands are made on the spacecraft with reference to mechanical packaging.

A related approach is to use a major portion of the reflector surface for a primary beam, and a smaller portion of the reflector surface is illuminated for auxiliary beams such as tracking beams, spacecraft command and control, a communication beam, etc. However, such configurations lead to interaction between the auxiliary reflector surface and the primary feed horns.

It can be seen, then, that there is a need in the art for antenna systems that can provide multiple beams from a single reflector surface. It can also be seen that there is a need in the art for single reflector surfaces that reduce the interaction between the reflector surface and the feed horns. It can also be seen that there is a need in the art for single reflector surfaces that have increased performance for multiple beam applications.

SUMMARY OF THE INVENTION

To overcome the limitations in the prior art described above, and to overcome other limitations that will become apparent upon reading and understanding the present specification, the present invention discloses a method for generating multiple antenna beams and a system for generating multiple antenna beams. The system comprises a first reflector surface that has a primary and at least a first auxiliary surface, and a second reflector surface, and also comprises first, second, and third feed horns. The first reflector surface and the second reflector surface may share a common axis of symmetry. The first feed horn illuminates the primary surface with radio frequency (RF) energy, the second feed horn illuminates the auxiliary surface with RF energy, and the third feed horn illuminates the second reflector surface with RF energy. The first feed horn and third feed horn are removed from an axis of symmetry of the auxiliary surface.

The method comprises illuminating a primary portion of a first reflector surface with RF energy from a first feed horn, illuminating an auxiliary portion of the first reflector surface with RF energy from a second feed horn, illuminating a second reflector surface with RF energy from a third feed horn, wherein the first feed horn and third feed horn are removed from an axis of symmetry of the auxiliary portion of the first reflector surface.

The present invention provides an antenna system that can provide multiple beams from a single reflector surface. The present invention also provides single reflector surfaces that reduce the interaction between the reflector surface and the feed horns. The present invention also provides single reflector surfaces that have increased performance for multiple beam applications.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Satellite Environment

Figure 1A:
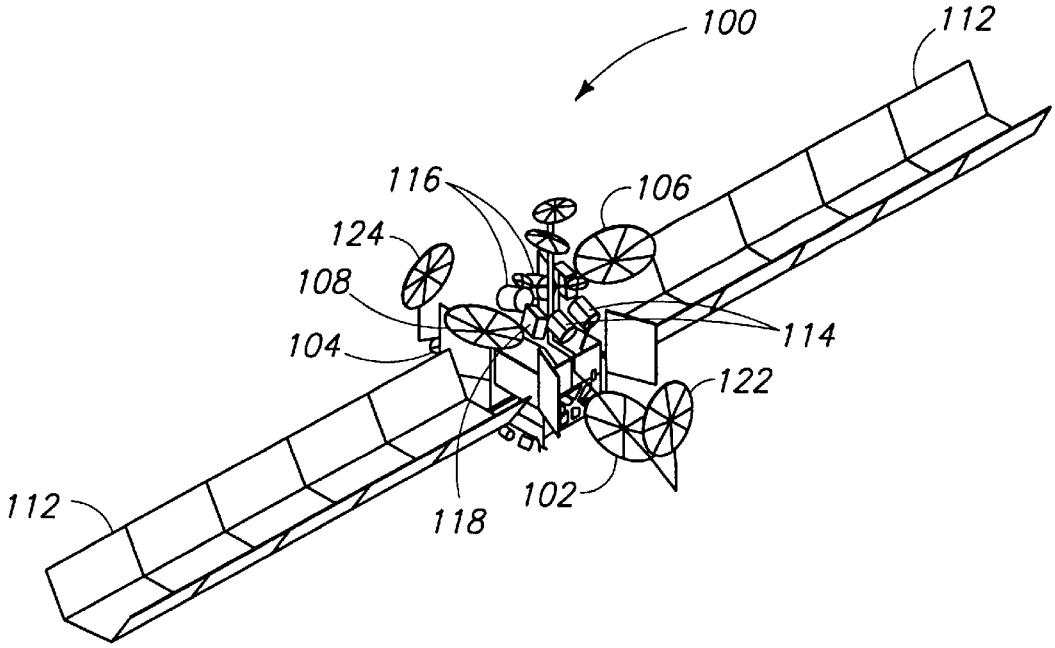
FIGS. 1A and 1B illustrate a typical satellite environment for the present invention.
Figure 1B:
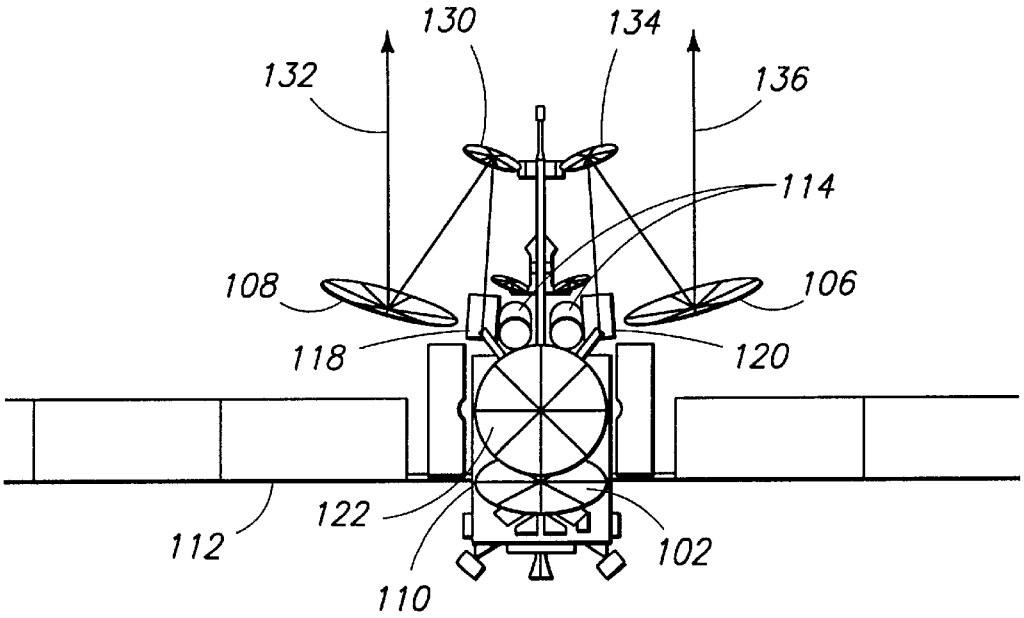

FIGS. 1A and 1B illustrate a typical satellite environment for the present invention.

Spacecraft 100 is illustrated with four antennas 102–108. Although shown as dual reflector antennas 102–108, antennas 102–108 can be direct fed single reflector antennas 102–108 without departing from the scope of the present invention. Antenna 102 is located on the east face of the spacecraft bus 110, antenna 104 is located on the west face of spacecraft bus 110, antenna 106 is located on the north part of the nadir face of the spacecraft bus 110, and antenna 108 is located on the south part of the nadir face of the spacecraft bus 110. Solar panels 112 are also shown for clarity.

Feed horns 114–120 are also shown. Feed horn 114 illuminates antenna 102, feed horn 116 illuminates antenna 104, feed horn 118 illuminates antenna 108, and feed horn 120 illuminates antenna 106. Feed horn 114 is directed towards subreflector 122, which is aligned with antenna 102. Feed horn 116 is directed towards subreflector 124, which is aligned with antenna 104. Feed horns 114–120 can be single or multiple sets of feed horns as desired by the spacecraft designer or as needed to produce the beams desired for geographic coverage. For example, feed horns 114 and 116 are shown as two banks of feed horns, but could be a single bank of feed horns, or multiple banks of feed horns, as desired. Antennas 102 and 104 are shown in a side-fed offset Cassegrain (SFOC) configuration, which are packaged on the East and West sides of the spacecraft bus 110. Antennas 106 and 108 are shown as offset Gregorian geometry antennas, but can be of other geometric design if desired. Further, antennas 102–108 can be of direct fed design, where the subreflectors are eliminated and the feed horns 114–120 directly illuminate reflectors 102–108 if desired. Further, any combination of Cassegrainian, Gregorian, SFOC, or direct illumination designs can be incorporated on spacecraft 100 without departing from the scope of the present invention.

Feed horn 118 illuminates subreflector 130 with RF energy, which is aligned with antenna 108 to produce output beam 132. Feed horn 120 illuminates subreflector 134 with RF energy, which is aligned with antenna 106 to produce beam 136. Beams 132 and 136 are used to produce coverage patterns on the Earth's surface. Beams 132 and 136 can cover the same geographic location, or different geographic locations, as desired. Further, feed horns 118 and 120 can illuminate the antennas 102–108 with more than one polarization of RF energy, i.e., left and right hand circular polarization, or horizontal and vertical polarization, simultaneously.

Although described with respect to satellite installations, the antennas described herein can be used in alternative embodiments, e.g., ground based systems, mobile based systems, etc., without departing from the scope of the present invention. Further, although the spacecraft 100 is described such that the feed horns 114–120 provide a transmitted signal from spacecraft 100 via the reflectors 102–108, the feed horns 114–120 can be diplexed such that signals can be received on the spacecraft 100 via reflectors 102–108.

Overview of the Present Invention

Satellites are typically required to generate multiple beams to provide multiple or overlapping geographical areas with communications signals. Typically, satellites use multiple antennas or a shaped reflector antenna to provide the multiple beams required. Shaped reflector antennas can be optimized for a given shaped beam, but it is desirable to generate multiple beams from a single shaped surface for ease of mechanical packaging.

Although multiple beam coverages can be obtained from a single shaped surface, there is a performance penalty associated with such an approach. The present invention reduces the performance penalty by configuring the antenna feed horns to minimize the undesirable effects of a single shaped reflector surface that generates multiple beam coverages. As such, the severe mechanical demands of multiple antenna reflector systems are eliminated by the present invention.

The Geometry of the Related Art

Figure 2:
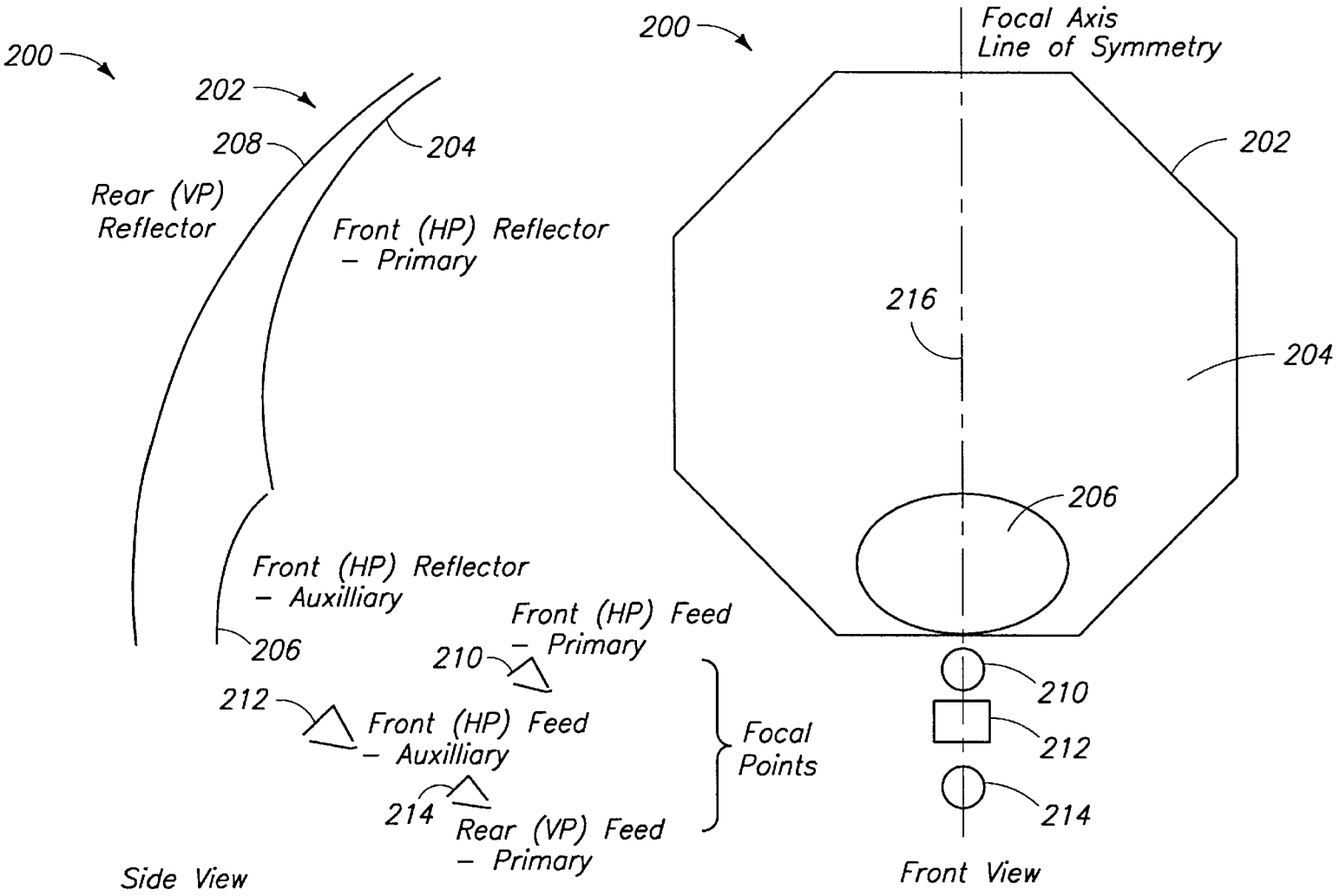
FIG. 2 illustrates a dual beam integrated surface antenna of the related art.

FIG. 2 illustrates front and side views of a dual beam integrated surface antenna of the related art.

System 200 comprises a dual surface reflector 202, with a front primary surface 204, a front auxiliary surface 206, and a rear reflector surface 208. Typically, the front primary surface 204 and front auxiliary surface 206 reflect horizontally polarized (HP) signals, whereas the rear reflector surface 208 typically reflects vertically polarized (VP) signals, but the polarizations for the surfaces 204–208 can be different without departing from the scope of the present invention.

Front primary feed horn 210 is aligned to illuminate front primary reflector surface 204. Auxiliary front feed horn 212 is aligned to illuminate front auxiliary surface 206, and rear feed horn 214 is aligned to illuminate rear surface 208. As shown in the front view, the focal points of the feed horns 210–214 are aligned with the focal axis line of symmetry 216 of the reflectors 204–208.

Each feed horn 210–214 and the respective reflective surface 204–208, because of the geometry and the polarization diversity, generates a distinct beam pattern emanating from system 200.

However, system 200, because the focal points of the feed horns 210–214 are along the line of symmetry, has undesirable interactions between the feed horns 210–214, which degrades the performance of the system 200.

Figure 3A:
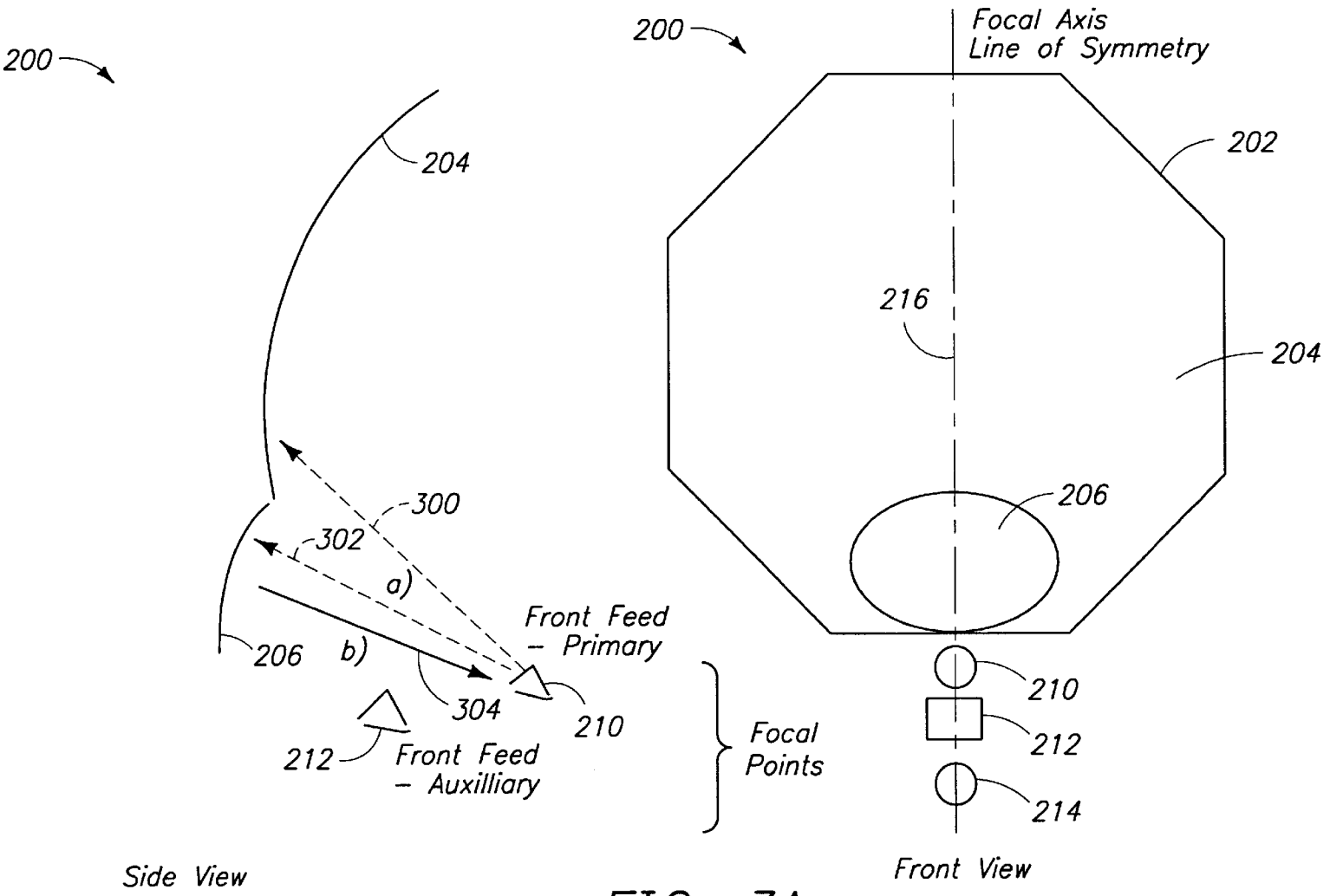
FIGS. 3A and 3B illustrate the undesirable interactions of the related art antenna system.
Figure 3B:
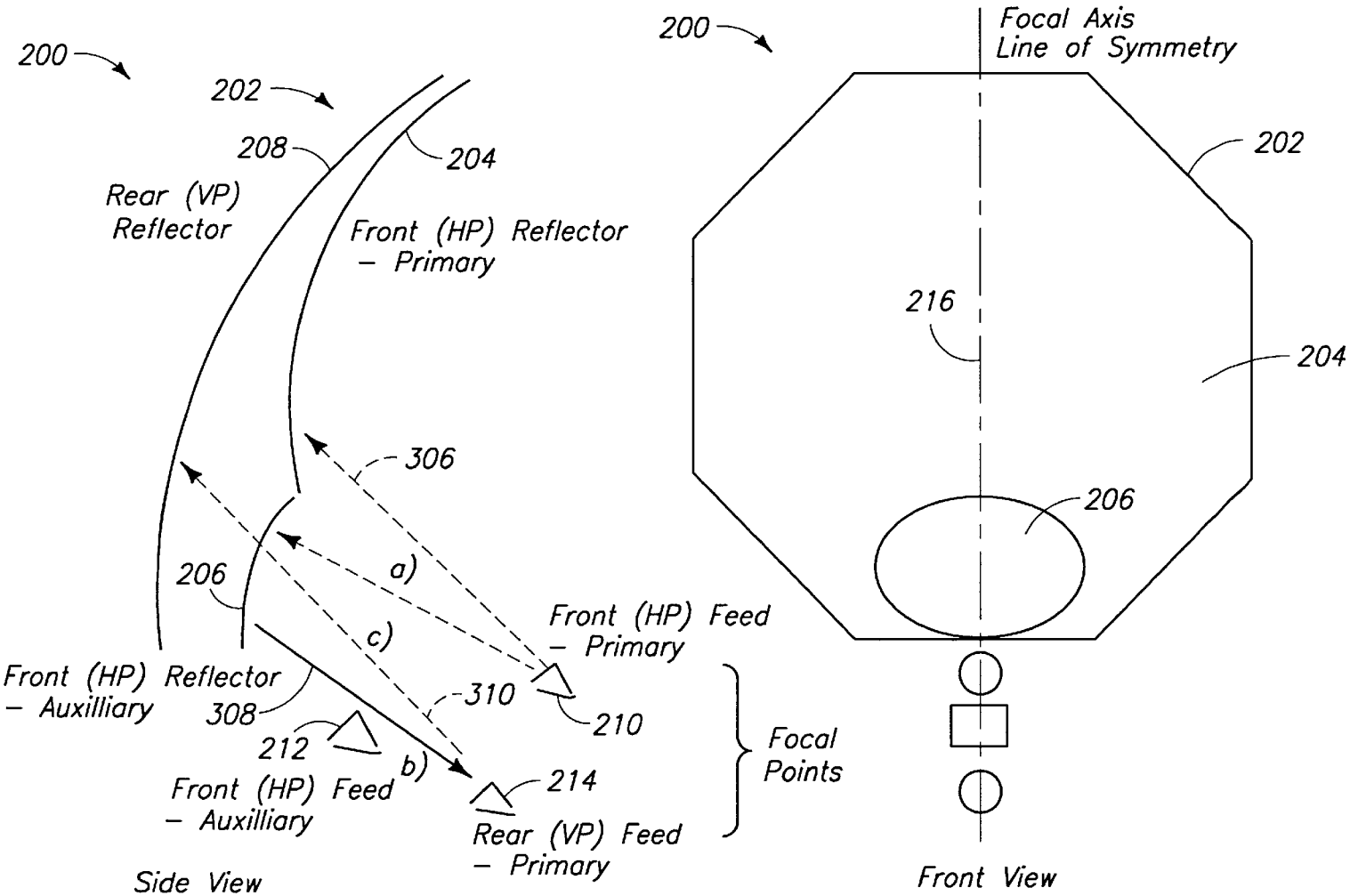

FIGS. 3A and 3B illustrate the undesirable interactions of the related art antenna system.

Although front primary feed horn 210 is aimed at the front primary reflective surface 204 to illuminate surface 204, it will also illuminate auxiliary surface 206. The illumination of surface 204 is shown as path 300, and the illumination of surface 206 is shown as path 302.

The surface of a parabolic reflector with a focal length f can be approximated as a sphere of radius 2 f having a center of curvature. Due to the inherent geometry, the primary feed horn 210 is in the vicinity of the center of curvature of the auxiliary reflective surface 206. Hence the fields from the primary feed horn 210 illuminates the auxiliary reflective surface 206, and the reflected RF energy refocuses on the primary feed horn 210 via path 304, leading to multiple interactions for the primary feed horn 210.

FIG. 3B illustrates when the primary feed horn 210 is offset from the center of curvature of the front auxiliary reflective surface 206, the primary feed horn 210 will illuminate the primary reflective surface 204 and the auxiliary surface 206 via path 306. However, the primary feed horn 210 new location reflects the RF energy from the auxiliary surface 206 towards the rear feed horn 214 via path 308, where it is then re-radiated towards the rear reflector 208 via feed horn 214. This will interfere with the rear feed horn 214's operation.

Figure 4:
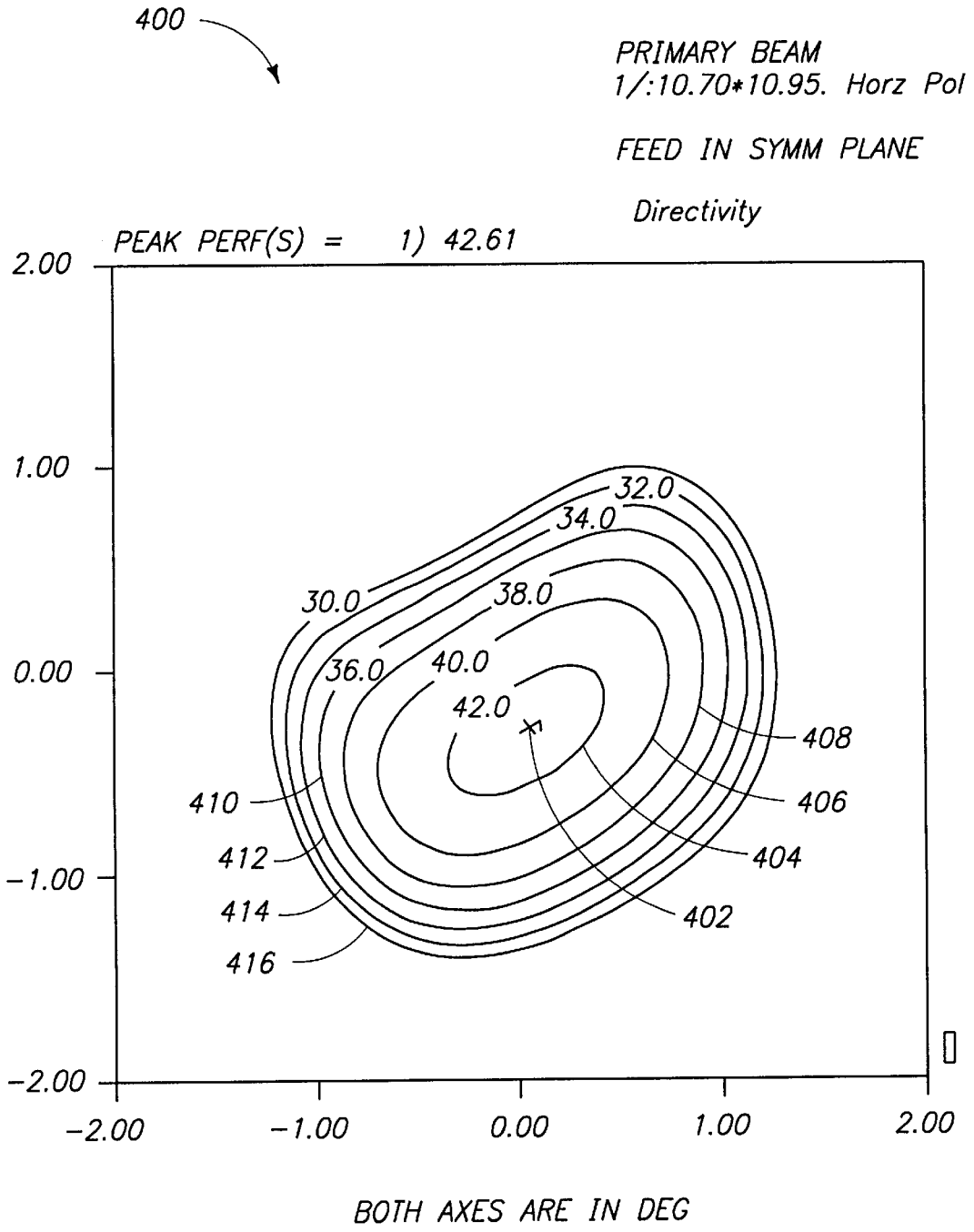
FIG. 4 illustrates a typical radiation pattern generated by the primary portion of the front surface of the related art.

FIG. 4 illustrates a typical radiation pattern generated by the primary portion of the front surface of the related art.

Graph 400 illustrates the radiation pattern, which has a peak performance at point 402 of 42.61 dB. Line 404 illustrates the equal power potential topography of the system 200 at a 42 dB level. Line 406 illustrates the equal power potential topography of the system 200 at a 40 dB level. Line 408 illustrates the equal power potential topography of the system 200 at a 38 dB level. Line 410 illustrates the equal power potential topography of the system 200 at a 36 dB level. Line 412 illustrates the equal power potential topography of the system 200 at a 34 dB level. Line 414 illustrates the equal power potential topography of the system 200 at a 32 dB level. Line 416 illustrates the equal power potential topography of the system 200 at a 30 dB level.

Figure 5:
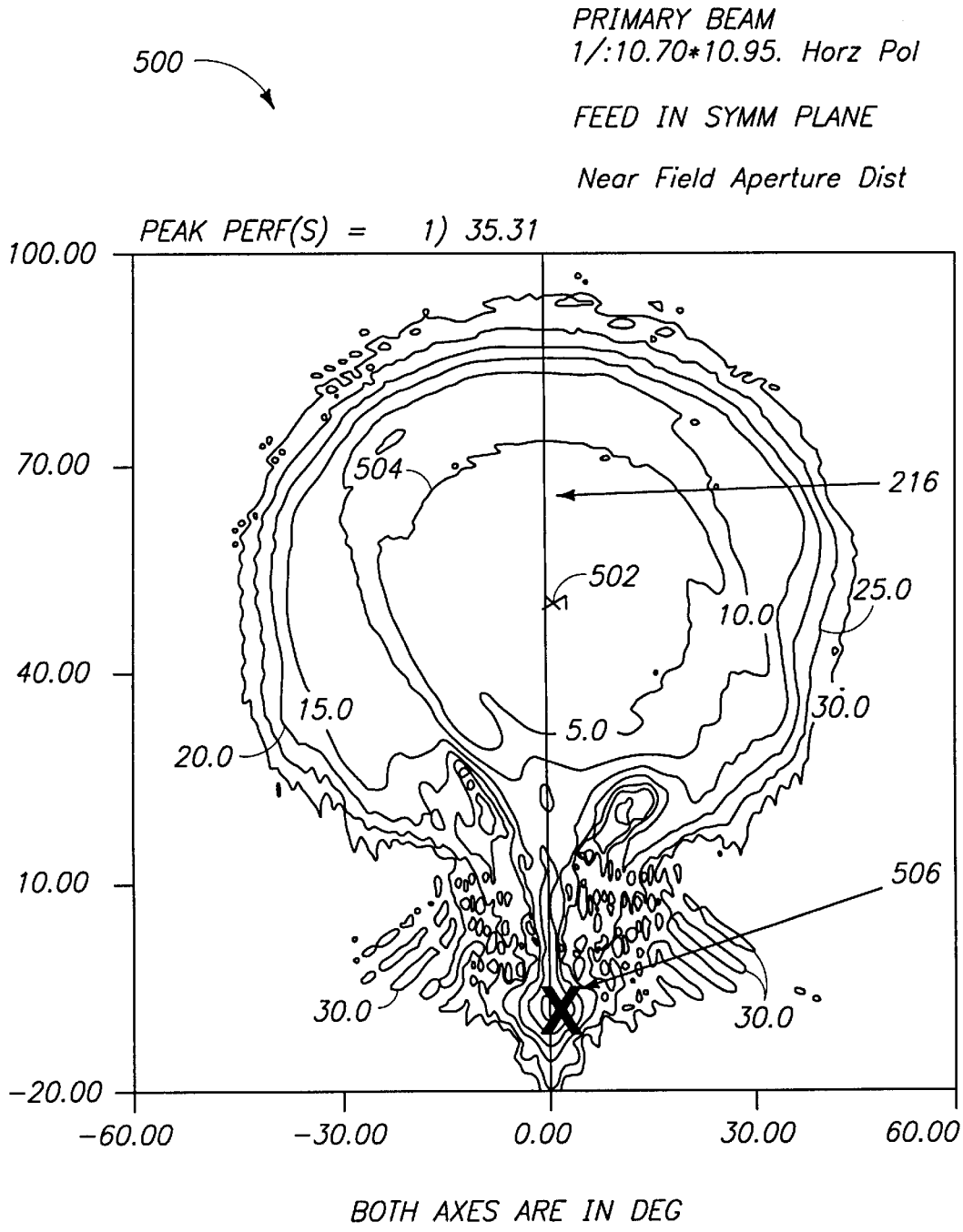
FIG. 5 illustrates the near-field aperture distribution of the related art in a vertical plane near the primary feed horns from the front primary surface when illuminated by the primary feed.

FIG. 5 illustrates the near-field aperture distribution 500 of the system of the related art in a vertical plane near the primary feed horns from the front primary surface when illuminated by the primary feed horn. Axis of symmetry 216 is illustrated, and the peak performance is marked as point 502. Equal power line 504 is shown to illustrate the 5 dB power loss area. The secondary peak 506 is caused by reflection from the auxiliary reflective surface 206. With this geometry of the related art, the secondary peak 506 falls very close to the physical location for the rear feed horn 214 for the back reflective surface 208, leading to strong coupling between the primary feed horn 210 and the rear feed horn 214.

Geometry of the Present Invention

In the system 200 described with respect to FIGS. 2–5, the focal points for the primary reflective surface 204 and the auxiliary surface 206 were along the line of symmetry 216. This symmetry leads to an undesirable interaction between the primary feed horn 210 and the auxiliary surface 206. By designing the focal point of at least one the reflective portions to be offset from the line of symmetry 216, this interaction can be minimized or controlled to acceptable levels.

The present invention is illustrated by showing the differences between the system 200 described with respect to FIGS. 2–5, although the present invention is not limited to the dual gridded reflector system as described herein.

Figure 6:
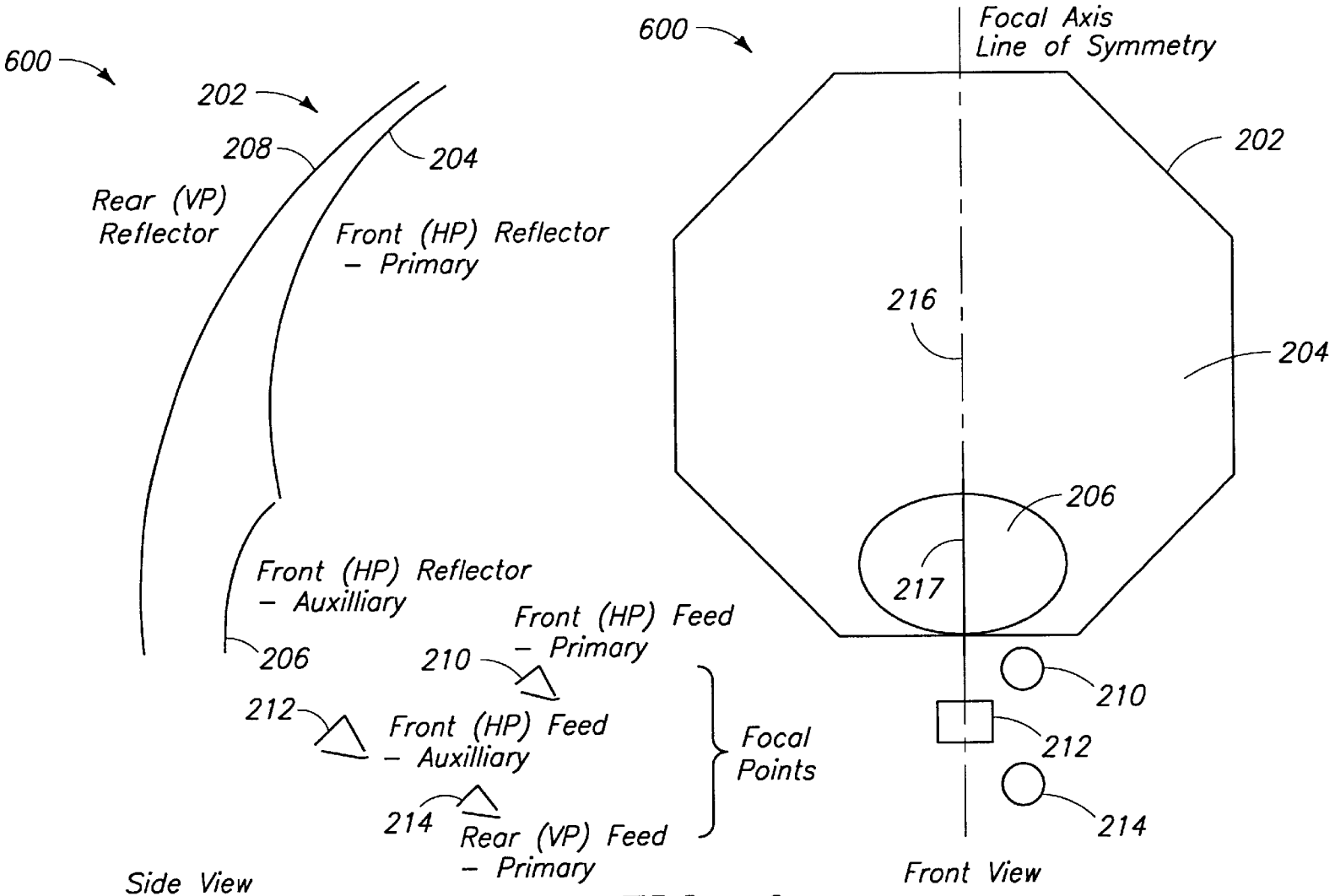
FIG. 6 illustrates the geometry of the present invention.

FIG. 6 illustrates the geometry of a first embodiment of the present invention.

System 600 comprises a dual surface reflector 202, with a front primary surface 204, a front auxiliary surface 206, and a rear reflector surface 208. Typically, the front primary surface 204 and front auxiliary surface 206 reflect horizontally polarized (HP) signals, whereas the rear reflector surface 208 typically reflects vertically polarized (VP) signals, but the polarizations for the surfaces 204–208 can be different without departing from the scope of the present invention.

Front primary feed horn 210 is aligned to illuminate front primary reflector surface 204. Auxiliary front feed horn 212 is aligned to illuminate front auxiliary surface 206, and rear feed horn 214 is aligned to illuminate rear surface 208. As shown in the front view, the front auxiliary surface 206 includes an axis of symmetry 217, which is typically, but not necessarily, aligned with an axis of symmetry of the front primary surface 216. The focal axis of symmetry for the rear reflector 208 may also be aligned with the focal axes of symmetry for the front primary surface 204 and the auxiliary surface 206. Front primary feed horn 210 and rear feed horn 214 are removed from the axis of symmetry of the front auxiliary surface 206. Thusly, each feed horn 210–214 and the respective reflective surface 204–208, because of the geometry and the polarization diversity, generates a distinct beam pattern emanating from system 600.

However, system 600 has offset the locations of the front primary feed horn 210 and rear primary feed horn 214 from the line of symmetry 216 to avoid the interactions associated with system 200.

Figure 7:
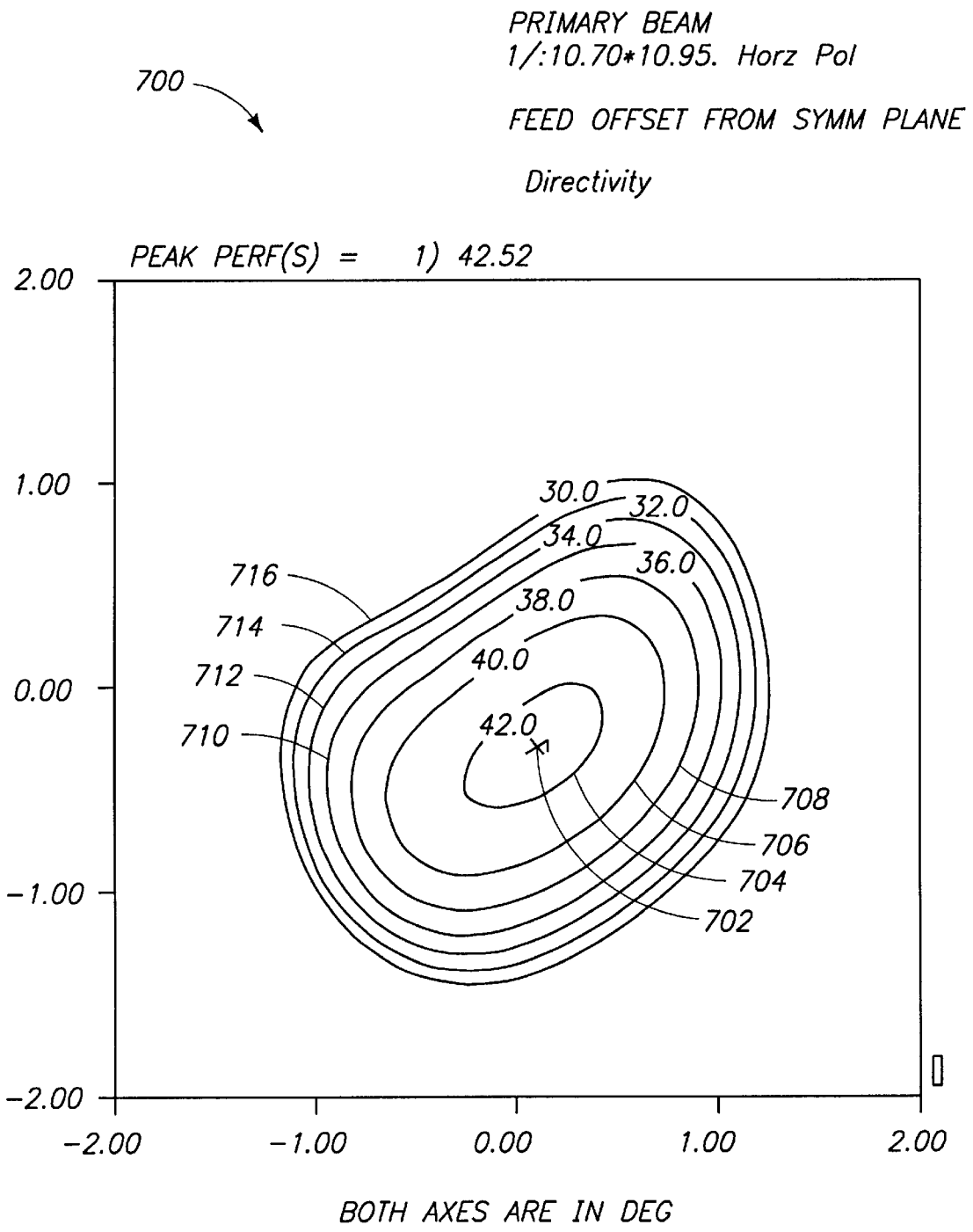
FIG. 7 illustrates a typical radiation pattern generated by the primary portion of the front surface of the present invention.

FIG. 7 illustrates a typical radiation pattern generated by the primary portion of the front surface of the present invention.

Graph 700 illustrates the radiation pattern, which has a peak performance at point 702 of 42.52 dB. Line 704 illustrates the equal power potential topography of the system 600 at a 42 dB level. Line 706 illustrates the equal power potential topography of the system 600 at a 40 dB level. Line 708 illustrates the equal power potential topography of the system 600 at a 38 dB level. Line 710 illustrates the equal power potential topography of the system 600 at a 36 dB level. Line 712 illustrates the equal power potential topography of the system 600 at a 34 dB level. Line 714 illustrates the equal power potential topography of the system 600 at a 32 dB level. Line 716 illustrates the equal power potential topography of the system 600 at a 30 dB level. The performance of system 600 is almost identical to that of system 200, as illustrated by comparing FIG. 7 to FIG. 4 discussed above.

Figure 8:
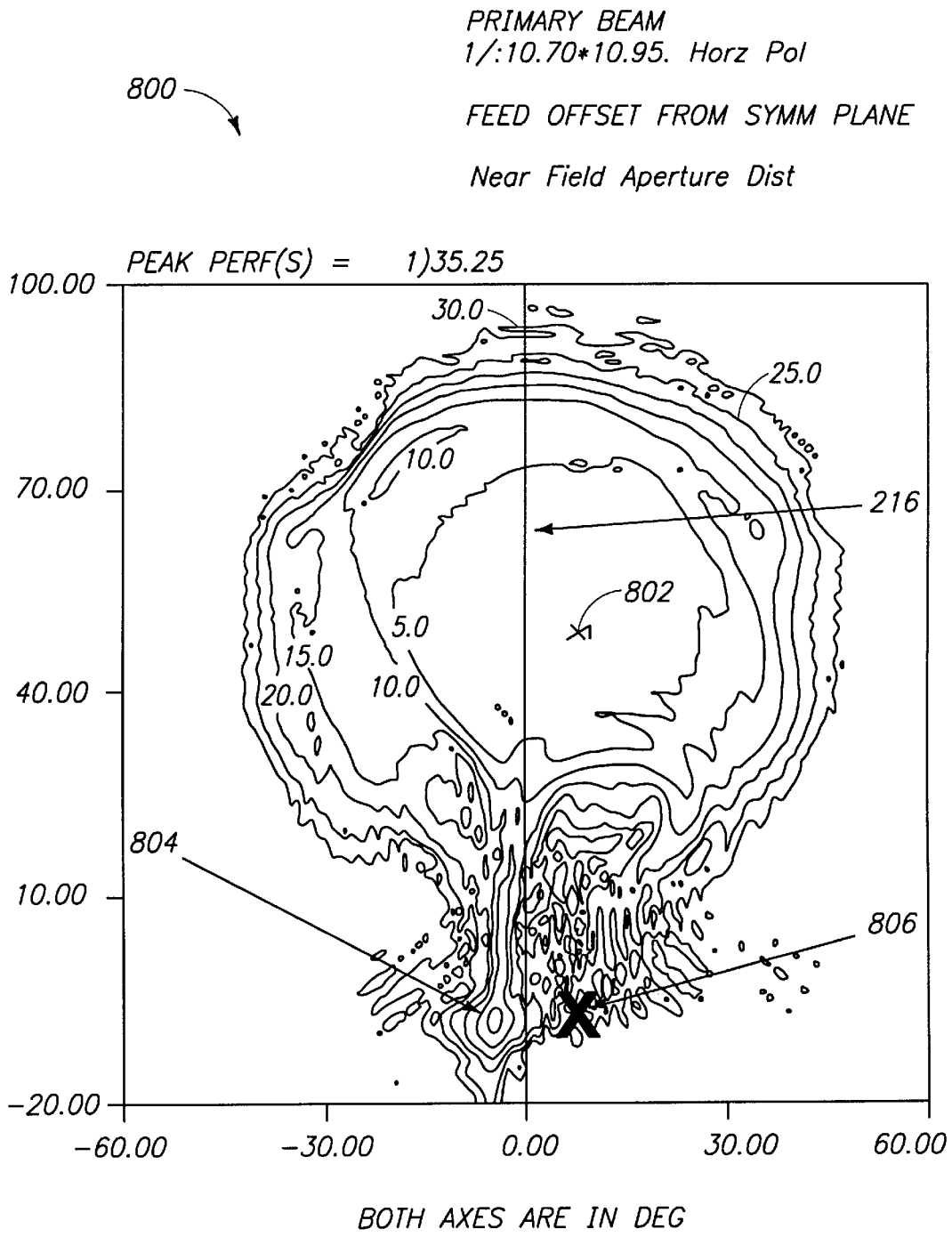
FIG. 8 shows the aperture distribution obtained with the geometry of the present invention.

FIG. 8 shows the aperture distribution obtained with the geometry of the present invention.

FIG. 8 illustrates the near-field aperture distribution 800 of the system of the present invention in a vertical plane near the primary feed horns from the front primary surface when illuminated by the primary feed horn. Axis of symmetry 216 is illustrated, and the peak performance is marked as point 802. The secondary peak 804 is caused by reflection from the auxiliary reflective surface 206. With the geometry of the present invention, the secondary peak 504 now falls at a different location from the physical location for the rear feed horn 214 for the back reflective surface 208, marked as point 806, which minimizes or eliminates the strong coupling between the primary feed horn 210 and the rear feed horn 214 of the related art as described in FIG. 5.

The field levels on the back reflector feed horn 214 are reduced by about 15 dB when using the present invention, resulting in a direct reduction in the coupling between primary feed horn 210 and rear feed horn 214.

Figure 9:
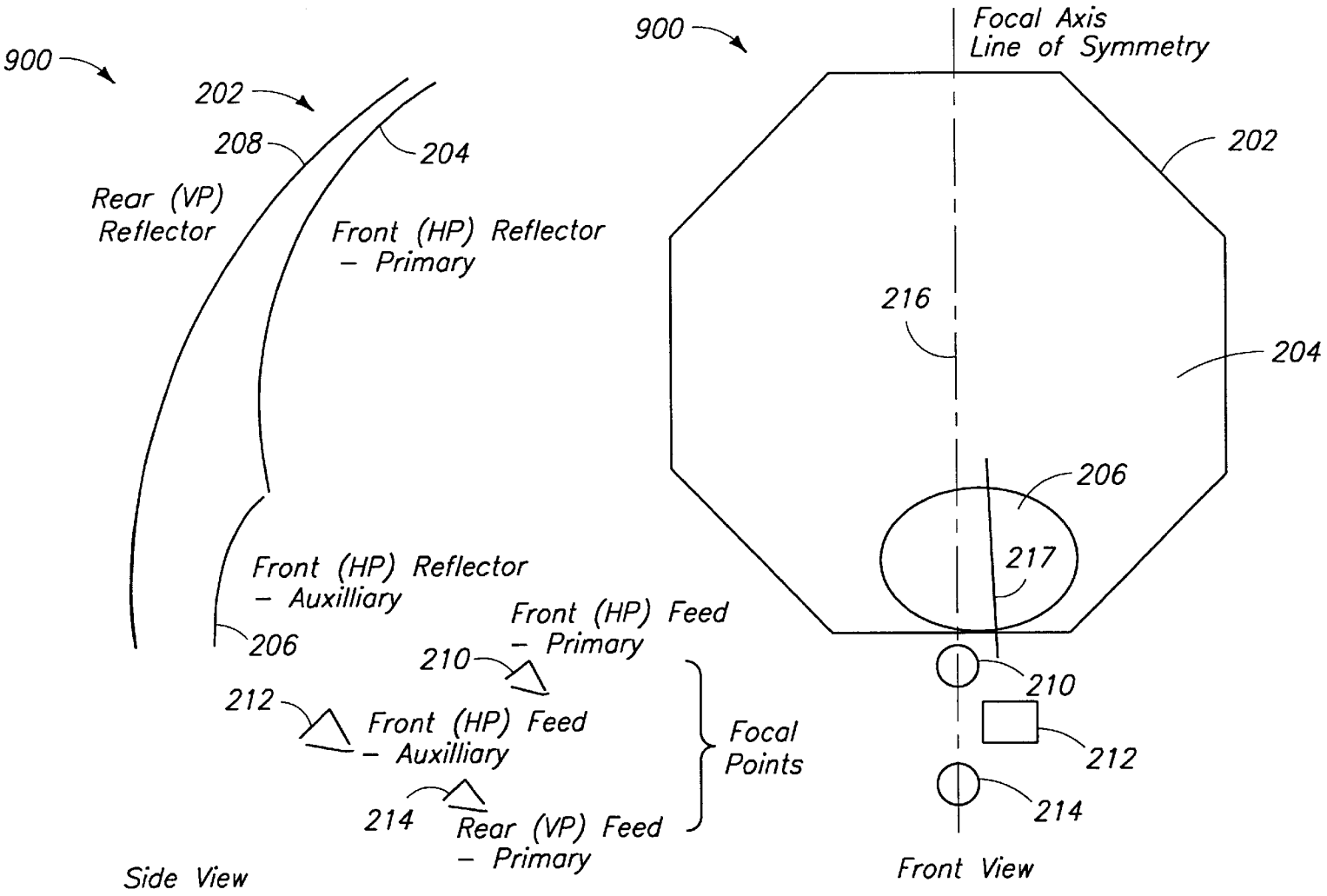
FIG. 9 illustrates an alternative embodiment of the present invention.

FIG. 9 illustrates an alternative embodiment of the present invention. System 900 comprises a dual surface reflector 202, with a front primary surface 204, a front auxiliary surface 206, and a rear reflector surface 208. Typically, the front primary surface 204 and front auxiliary surface 206 reflect horizontally polarized (HP) signals, whereas the rear reflector surface 208 typically reflects vertically polarized (VP) signals, but the polarizations for the surfaces 204–208 can be different without departing from the scope of the present invention.

Front primary feed horn 210 is aligned to illuminate front primary reflector surface 204. Auxiliary front feed horn 212 is aligned to illuminate front auxiliary surface 206, and rear feed horn 214 is aligned to illuminate rear surface 208. As shown in the front view, the focal axis line of symmetry 217 for the front auxiliary surface 206 is removed from the axis of symmetry 216 for the front primary reflector surface 204. Thusly, system 900 has offset the locations of the auxiliary front feed horn 212 and the axis of symmetry 217 of the auxiliary reflective surface 206 from the line of symmetry 216 to avoid the interactions associated with system 200. System 900 yields similar results to that of system 600 described with respect to FIG. 6.

Process Chart

Figure 10:
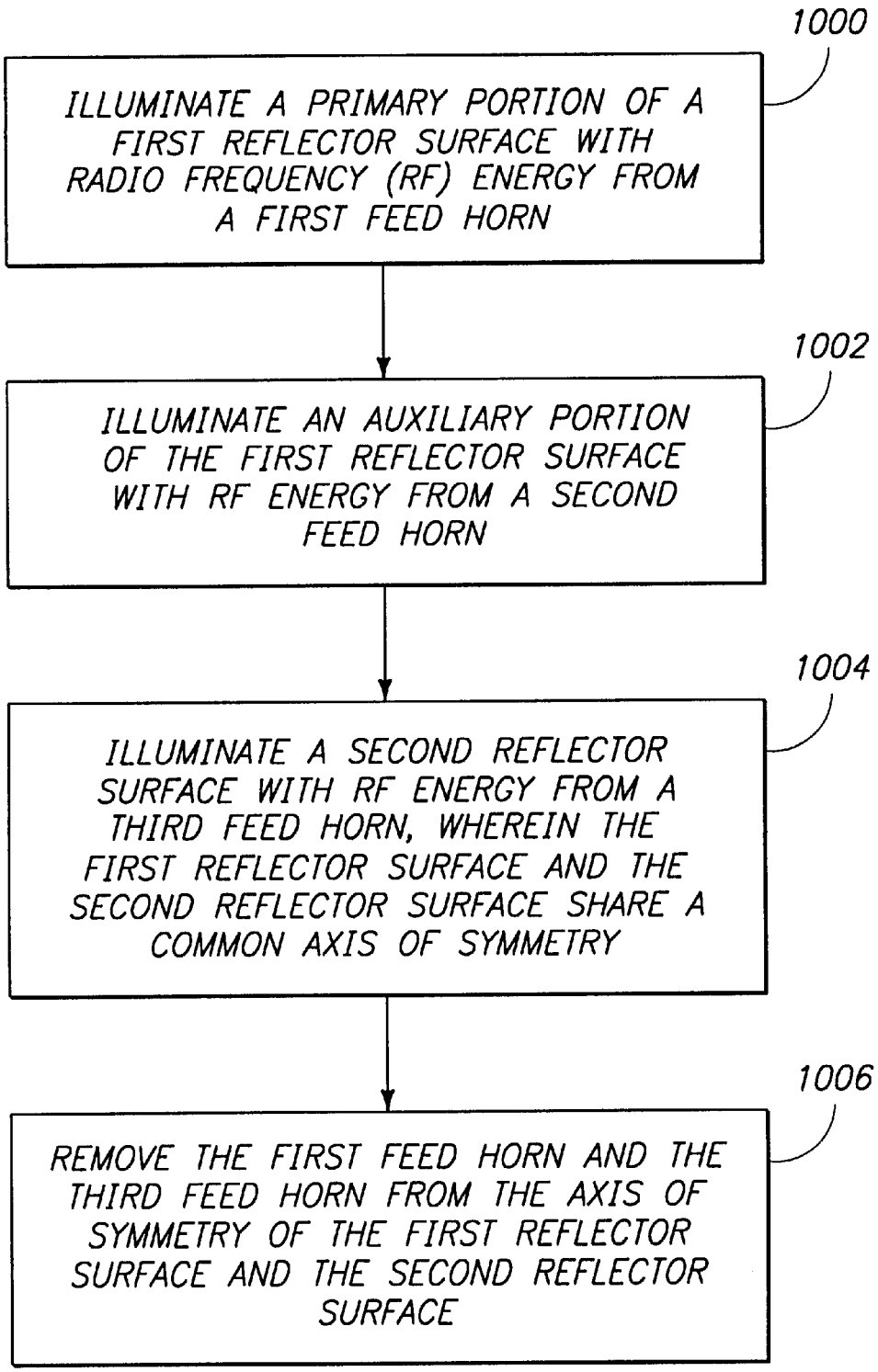
FIG. 10 is a flow chart illustrating the steps used to practice the present invention.

FIG. 10 is a flow chart illustrating the steps used to practice the present invention.

Block 1000 illustrates performing the step of illuminating a primary portion of a first reflector surface with (RF) energy from a first feed horn.

Block 1002 illustrates performing the step of illuminating an auxiliary portion of the first reflector surface with RF energy from a second feed horn.

Block 1004 illustrates performing the step of illuminating a second reflector surface with RF energy from a third feed horn, wherein the first feed horn and third feed horn are removed from an axis of symmetry of the auxiliary portion of the first reflector surface.

The present invention can have multiple reflective surfaces on the rear reflector surface as well as the front reflector surface, and can have more than two reflective surfaces on one or both of the front and reflective surfaces, without departing from the scope of the present invention.

In summary, the present invention discloses a method for generating multiple antenna beams and a system for generating multiple antenna beams. The system comprises a first reflector surface that has a primary and at least a first auxiliary surface, and a second reflector surface, and also comprises first, second, and third feed horns. The first reflector surface and the second reflector surface may share a common axis of symmetry. The first feed horn illuminates the primary surface with radio frequency (RF) energy, the second feed horn illuminates the auxiliary surface with RF energy, and the third feed horn illuminates the second reflector surface with RF energy. The first feed horn and third feed horn are removed from an axis of symmetry of the first auxiliary surface.

The method comprises illuminating a primary portion of a first reflector surface with radio frequency (RF) energy from a first feed horn, illuminating an auxiliary portion of the first reflector surface with RF energy from a second feed horn, illuminating a second reflector surface with RF energy from a third feed horn, wherein the first feed horn and third feed horn are removed from an axis of symmetry of the auxiliary portion of the first reflector surface.

Conclusion

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An antenna system for generating multiple beams, comprising:

a first reflector surface, comprising a primary surface and at least a first auxiliary surface;

a second reflector surface;

a first feed horn aligned to illuminate the primary surface with radio frequency (RF) energy;

a second feed horn, aligned to illuminate the auxiliary surface with RF energy; and a third feed horn, aligned to illuminate the second reflector surface with RF energy, wherein the first feed horn and third feed horn are removed from an axis of symmetry of the first auxiliary surface.

2. The antenna system of claim 1, wherein the first reflector surface and the second reflector surface share a common axis of symmetry.

3. The antenna system of claim 1, wherein the first reflector surface reflects a first polarization of RF energy and the second reflector surface reflects a second polarization of RF energy.

4. The antenna system of claim 3, wherein the first polarization of RF energy is horizontal polarization and the second polarization of RF energy is vertical polarization.

5. The antenna system of claim 3, wherein the first polarization of RF energy is vertical polarization and the second polarization of RF energy is horizontal polarization.

6. The antenna system of claim 1, wherein the primary surface comprises more than one auxiliary surface.

7. The antenna system of claim 6, wherein each of the auxiliary surfaces has an associated feed horn aligned to illuminate the associated auxiliary surface.

8. An antenna system for generating multiple beams, comprising:

a first reflector surface, comprising a primary surface and at least a first auxiliary surface;

a second reflector surface;

a first feed horn aligned to illuminate the primary surface with radio frequency (RF) energy;

a second feed horn, aligned to illuminate the auxiliary surface with RF energy; and a third feed horn, aligned to illuminate the second reflector surface with radio frequency (RF) energy, wherein the second feed horn and an axis of symmetry of the auxiliary surface are removed from an axis of symmetry of the primary surface.

9. The antenna system of claim 8, wherein the first reflector surface and the second reflector surface share a common axis of symmetry.

10. The antenna system of claim 8, wherein the first reflector surface reflects a first polarization of RF energy and the second reflector surface reflects a second polarization of RF energy.

11. The antenna system of claim 10, wherein the first polarization of RF energy is horizontal polarization and the second polarization of RF energy is vertical polarization.

12. The antenna system of claim 10, wherein the first polarization of RF energy is vertical polarization and the second polarization of RF energy is horizontal polarization.

13. The antenna system of claim 8, wherein the primary surface comprises more than one auxiliary surface.

14. The antenna system of claim 13, wherein each of the auxiliary surfaces has an associated feed horn aligned to illuminate the associated auxiliary surface, and each of the auxiliary surfaces and associated feed horns are removed from the axis of symmetry.

15. A method for generating multiple output beams from an antenna system, comprising:

illuminating a primary portion of a first reflector surface with radio frequency (RF) energy from a first feed horn;

illuminating an auxiliary portion of the first reflector surface with RF energy from a second feed horn;

illuminating a second reflector surface with RF energy from a third feed horn; and wherein the first feed horn and third feed horn are removed from an axis of symmetry of the auxiliary portion of the first reflector surface.

16. The method of claim 15, wherein the first reflector surface reflects a first polarization of RF energy and the second reflector surface reflects a second polarization of RF energy.

17. The method of claim 16, wherein the first polarization of RF energy is horizontal polarization and the second polarization of RF energy is vertical polarization.

18. The method of claim 16, wherein the first polarization of RF energy is vertical polarization and the second polarization of RF energy is horizontal polarization.

19. The method of claim 15, wherein the primary surface comprises more than one auxiliary surface.

20. The method of claim 19, wherein each of the auxiliary surfaces has an associated feed horn aligned to illuminate the associated auxiliary surface.

* * * * *